US005669558A

United States Patent [19]

Ichel

[11] Patent Number: 5,669,558

[45] Date of Patent: Sep. 23, 1997

[54] WATERPOWER PRESSURE WASHER

[76] Inventor: Glenn K. Ichel, 21 Winslow La., Smithtown, N.Y. 11787

[21] Appl. No.: 509,513

[22] Filed: Jul. 31, 1995

[51] Int. Cl.[6] ..... B05B 7/26; B05B 7/30

[52] U.S. Cl. ..... 239/311; 239/316; 239/318; 239/428.5; 239/458; 239/532

[58] Field of Search ..... 239/310, 311, 239/316, 318, 280, 428.5, 432, 458, 525, 526, 532

[56] References Cited

U.S. PATENT DOCUMENTS

| | | | |
|---|---|---|---|
| 188,909 | 3/1877 | Howard | 239/525 |
| 758,817 | 5/1904 | Brown et al. | 239/316 X |
| 1,226,443 | 5/1917 | Baker | 239/280 |
| 1,346,750 | 3/1920 | Herman | 239/530 X |
| 2,329,711 | 6/1943 | Gilsenan | 239/531 |
| 3,632,046 | 1/1972 | Hengesbach | 239/318 |
| 3,727,841 | 4/1973 | Hengesbach . | |
| 3,915,382 | 10/1975 | Davis . | |
| 3,949,970 | 4/1976 | ter Braak | 239/432 X |
| 4,982,896 | 1/1991 | Crow . | |
| 5,169,068 | 12/1992 | Bertolini . | |

FOREIGN PATENT DOCUMENTS

| | | | |
|---|---|---|---|
| 3826784 | 2/1990 | Germany | 239/526 |
| 326232 | 5/1935 | Italy | 239/458 |

*Primary Examiner*—Andres Kashnikow
*Assistant Examiner*—Robin O. Evans
*Attorney, Agent, or Firm*—Michael I. Kroll

[57] ABSTRACT

A waterpower pressure washer (16) comprising an elongated tapered barrel (18). A hollow cylindrical body (20) is integral with and fluidly connected at a slight angle to the elongated tapered barrel (18). A structure (22) is for coupling the hollow cylindrical body (20) to a source of pressurized water. The pressurized water can travel through the hollow cylindrical body (20) and the elongated tapered barrel (18). A nozzle (24) is at a distal end of the elongated tapered barrel (18). The pressurized water can be sprayed from the nozzle (24) to clean a surface of an object (26).

30 Claims, 3 Drawing Sheets

18
58

18
58
24

74
60
18

60
20
8
74
34

18
24
10
66
62
60
18
64
10

75
60
18

18
11
60
70
68
72
62

70
68
18
72
60
62

18

76
60
18

15
82
78
15
84
60

18
82
80
84
60
78

WATERPOWER PRESSURE WASHER

BACKGROUND OF THE INVENTION

1. Field of the Invention

The instant invention relates generally to pressurized fluid dispensers and more specifically it relates to a waterpower pressure washer.

2. Description of the Prior Art

Numerous pressurized fluid dispensers have been provided in prior art. For example, U.S. Pat. Nos. 3,727,841 to Hengesbach; 3,915,382 to Davis; 4,982,896 to Crow and 5,169,068 to Bertolini all are illustrative of such prior art. While these units may be suitable for the particular purpose to which they address, they would not be as suitable for the purposes of the present invention as heretofore described.

HENGESBACH, ROBERT W.

MULTIPLE JET FLUID SPRINKLING, SPRAYING AND DIFFUSING DEVICE

U.S. Pat. No. 3,727,841

Small diameter, normally straight tubes, some having discharge ports distributed along their lengths, and some being imperforate, are detachably connected in selected orders to form an elongated dispensing pipe line which is connectable at one end to a source of fluid under pressure and is plugged at the other end. The tubes are readily flexible transversely of their axes into curvilinear shapes throughout a wide range of raddi, ranging from about 6 inches upwardly, by forces applied by the hands of an operator while his hands directly grip the tube. The tubes retain their normal cross sectional shape when so curved. They are of a plastic material having a good memory so that they are self-restoring or readily restorable manually to original lineal condition by reverse bending by hand. They are highly resistant to permanent or elastic deformation, or radial collapse, of their cross section. The tubes are so fully resistant to torsional deformation by manually applied forces and the coupling between the tubes hold the tubes so tightly that an operator, by applying rotational or torsional forces to any one of the tubes manually while gripping it directly in his hands, can rotate the entire line as a unit with each tube retaining its fixed rotated position relative to the others. The tubes can be connected together with the ports of any tube directed at a different angle about the common axis from the ports of other tubes. The ports of some tubes may be arranged in pairs with the ports of each pair directed so that the discharged jets impinge on each other abruptly and create a fog or mist. The tubes may be detachably connected together in various rotated positions about their axes, and also with their axes in various angular positions resistive to each other for building temporary shower and auto washing structures.

DAVIS, J.C.

EXTENSION SPRAY GUN

U.S. Pat. No. 3,915,382

An extension spray gun comprising a telescopically extendable pole having a spray nozzle secured to one end of the pole. A valve secured to the other end is to control flow of paint through a flexible hose connected to the spray nozzle.

CROW, LEE

SPRAY WAND

U.S. Pat. No. 4,982,896

A fluid wand including a pistol grip, a nozzle and a tubular body communicating therebetween. The nozzle includes a hemispherical end wall adjacent a slit like opening configured as a rectangular box-like passageway. The piston grip maintains constant pressure on either side of an on/off valve. The emerging flow emanating therefrom is configured initially as an elongate ribbon which thereafter, due to enhanced cohesive forces engendered in a hemispherical end wall portion of the nozzle, causes the ribbon to reform as a substantially solid cylindrical shaft of fluid.

BERTOLINI, FRANCA

HAND-HELD JET WASHER

U.S. Pat. No. 5,169,068

A jet washer for producing a high-pressure water jet includes an electric motor, a motor reduction gear and a pump formed as a single assembly with a lance. This single assembly is hand-holdable by the user. To enable it to be easily held, the jet washer is provided with handles or grips and possibly with a shoulder strap to enable it to be carried on the shoulders of the user. A device can be provided for mixing water with detergent taken from a suitable container provided on the body of the jet washer.

SUMMARY OF THE INVENTION

A primary object of the present invention is to provide a waterpower pressure washer that will overcome the shortcomings of the prior art devices.

Another object is to provide a waterpower pressure washer that is made primarily out of lightweight, durable plastic and small metal components, which will dramatically increase water pressure from a standard garden hose.

An additional object is to provide a waterpower pressure washer that is safe to use since there is no electric cord, cleans any surface with water without harming the surface, while high pressure is experienced with the nozzle held within twelve inches from the surface being cleaned.

A further object is to provide a waterpower pressure washer that is simple and easy to use.

A still further object is to provide a waterpower pressure washer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
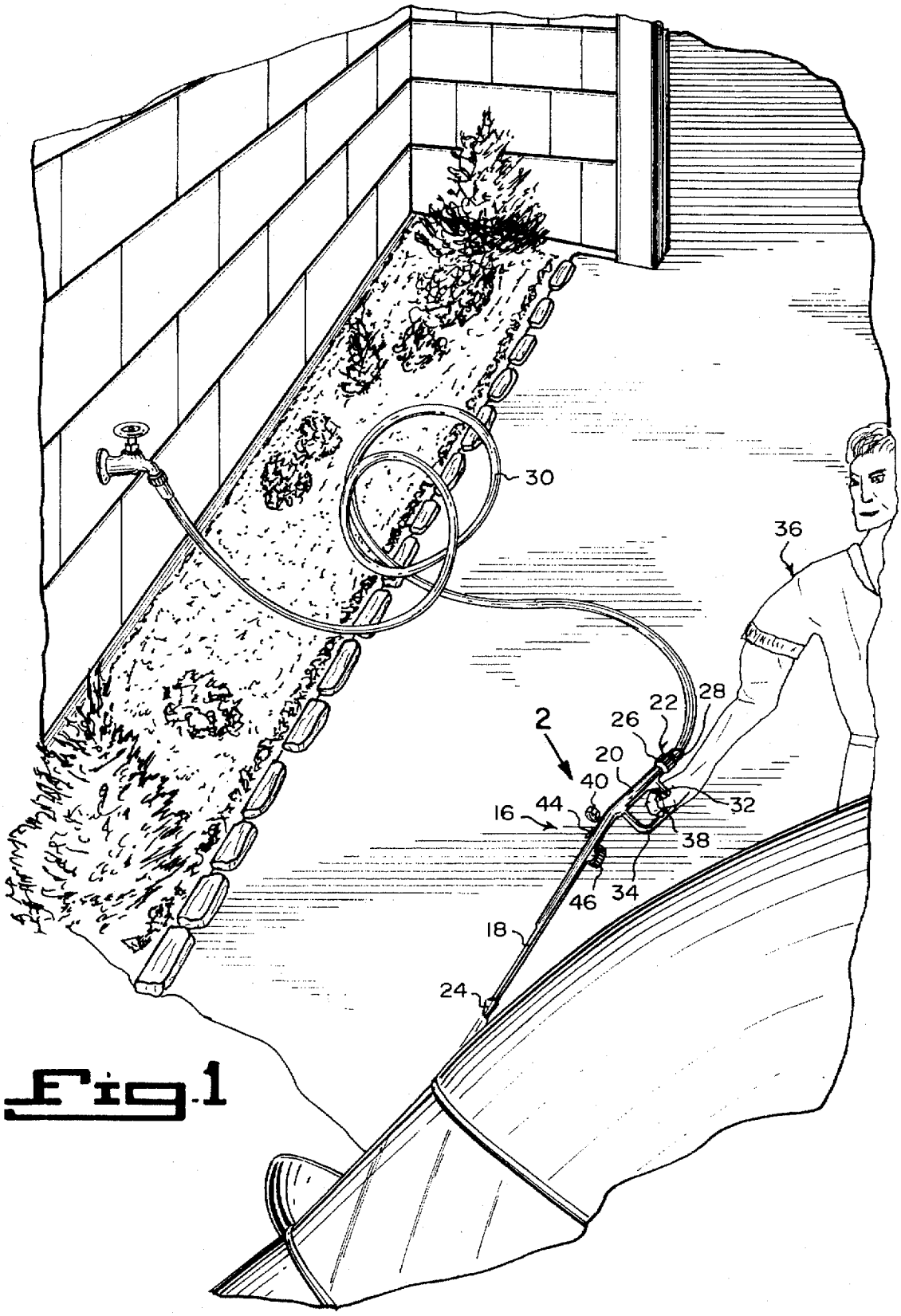
FIG. 1 is a perspective view showing the instant invention connected to a garden hose and being used.
Figures 2, 3, 4:
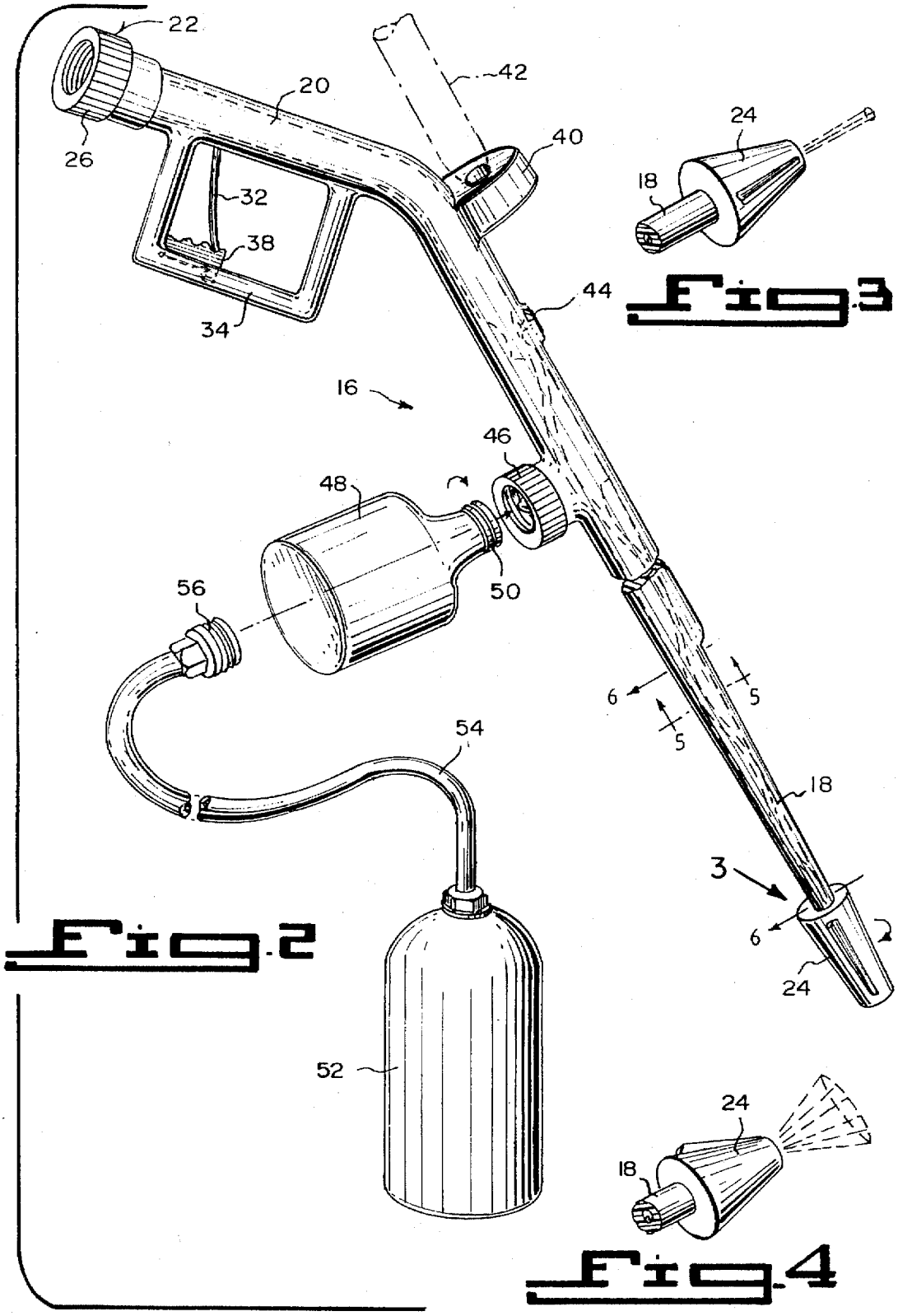
FIG. 2 is an enlarged perspective view of the instant invention per se taken in the direction of arrow 2 in FIG. 1 with parts broken away, showing possible additives for the optional hook-up socket and a handle attachment in phantom.
FIG. 3 is a perspective view taken in the direction of arrow 3 in FIG. 2, showing the adjustable nozzle providing a narrow spray.
FIG. 4 is a perspective view similar to FIG. 3, showing the adjustable nozzle providing a wide spray.

Turning now descriptively to the drawings, in which similar reference characters denote similar elements throughout the several views, FIGS. 1 and 2 illustrate a waterpower pressure washer 16 comprising an elongated tapered barrel 18. A hollow cylindrical body 20 is integral with and fluidly connected at a slight angle to the elongated tapered barrel 18. A structure 22 is for coupling the hollow cylindrical body 20 to a source of pressurized water. The pressurized water can travel through the hollow cylindrical body 20 and the elongated tapered barrel 18. A nozzle 24 is at a distal end of the elongated tapered barrel 18. The pressurized water can be sprayed from the nozzle 24, to clean a surface of an object 26.

The coupling structure 22 is a hose connector 26 on a free end of the hollow cylindrical body 20 to engage with a fitting 28 on a garden hose 30. The nozzle 24 is adjustable on the distal end of the elongated tapered barrel 18, so that the spray from the nozzle 24 can be changed from a narrow spray, as shown in FIG. 3, to a wide spray, as shown in FIG. 4.

A trigger 32 is located on the hollow cylindrical body 20, so as to turn the pressurized water on and off, as well as to intermediate positions. A handgrip trigger guard 34 is on the hollow cylindrical body 20 adjacent the trigger 32, so as to enable a person 36 to hand hold the handgrip trigger guard 34 and operate the trigger 32.

A locking mechanism 38 is in the handgrip trigger guard 34. The locking mechanism 38 can hold the trigger 32 in an operative position, to allow the pressurized water to continuously flow therethrough. A threaded socket 40 is on the elongated tapered barrel 18 adjacent the hollow cylindrical body 20. A long handle attachment 42, shown in phantom lines in FIG. 2, can be connected to the threaded socket 40, allowing a person 36 gripping the long handle attachment 42 to reach hard to reach places for cleaning.

A pressure adjustment lever 44 is in the elongated tapered barrel 18 to control the flow of the pressurized water therethrough. An optional hook-up socket 46 is fluidly connected on the elongated tapered barrel 18. Additives in a bottle 48 with threaded neck 50 and a tank 52 with flexible tube 54 having a threaded fitting 56, can be attached to the optional hook-up socket 46 and be introduced therethrough, as shown in FIG. 2. A pair of internal spiral deflectors 58, as illustrated in FIGS. 5 and 6, are within the elongated tapered barrel 18, to agitate the water and help increase the pressure of the water, while also enhancing the scrubbing action of the water as it exits the nozzle 24.

In FIGS. 7 through 15, facilities 60 are on the elongated tapered barrel 18, for introducing air therein to help accelerate the flow of water therethrough. The air introducing facility 60 in FIG. 9, 10, 11 and 15 is an air inlet assembly 62. The air inlet assembly 62 in FIG. 9 includes a collar 64 mounted on the elongated tapered barrel 18. A plurality of one-way air valves 66 are radially placed into the elongated tapered barrel 18 on the collar 64 to introduce the air therein.

Figures 5, 6, 7, 8, 9, 10, 11, 12, 13, 14, 15:
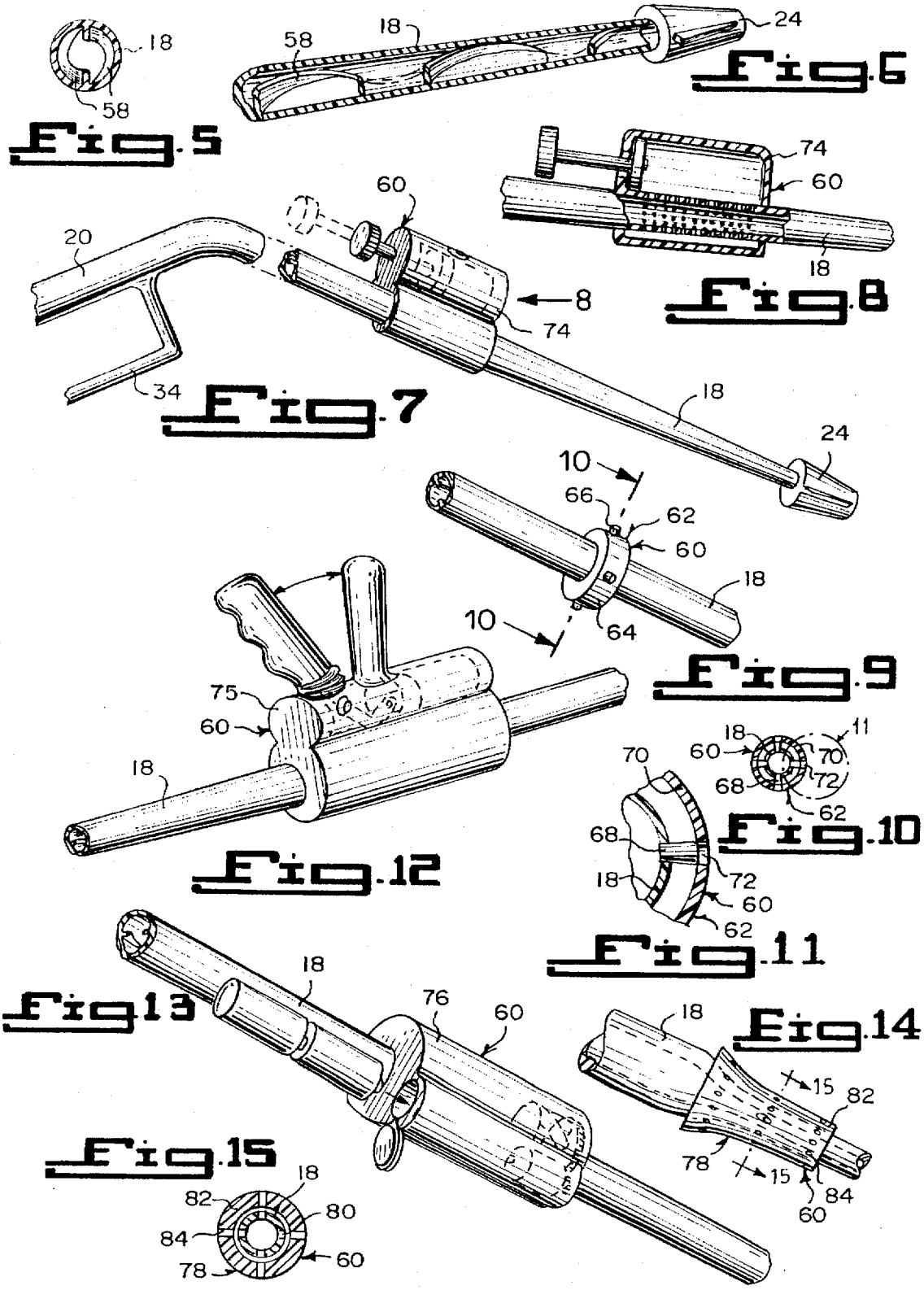
FIG. 5 is a cross sectional view taken along line 5—5 in FIG. 2, showing the internal spiral water deflectors.
FIG. 6 is a cross sectional perspective view taken along line 6—6 in FIG. 2, showing one of the internal spiral water deflectors.
FIG. 7 is a perspective view of a portion of the instant invention with parts broken away, showing a hand pump mounted thereon.
FIG. 8 is an elevational view taken in the direction of arrow 8 in FIG. 7 with parts broken away and in section.
FIG. 9 is a perspective view of a portion of the elongated tapered barrel, showing a air inlet assembly mounted thereon.
FIG. 10 is a cross sectional view taken along line 10—10 in FIG. 9, showing a first alternate air inlet assembly whereby the collar is rotatable.
FIG. 11 is an enlarged cross sectional view as indicated by arrow 11 in FIG. 10, showing part of the internal structure of the first alternate air inlet assembly in greater detail.
FIG. 12 is a perspective view of a portion of the elongated tapered barrel, showing a hand grip pump mounted thereon.
FIG. 13 is a perspective view of a portion of the elongated tapered barrel, showing a battery operated pump mounted thereon, with batteries ready to be installed within a battery compartment.
FIG. 14 is an elevational view of a portion of the elongated tapered barrel, showing a second alternate air inlet assembly mounted thereon, whereby the sleeve is revolvable.
FIG. 15 is a cross sectional view taken along line 15—15 in FIG. 14.

The air inlet assembly 62 in FIG. 10 and 11, consists of a plurality of air valves 68 radially placed into the elongated tapered barrel 18. A collar 70 is provided, having a plurality of apertures 72. The collar 70 is rotatively positioned on the elongated tapered barrel 18 over the air valves 68. When the apertures 72 are in alignment with the air valves 68, air will be introduced into the elongated tapered barrel 18.

The air introducing facility 60 in FIGS. 7 and 8, is a hand pump 74 built into the elongated tapered barrel 18. The air introducing facility in FIG. 12 is a hand grip pump 75 built into the elongated tapered barrel 18. The air introducing facility 60 in FIG. 13, is a battery operated pump 76 built into the elongated tapered barrel 18. The air introducing facility 60 in FIGS. 14 and 15, is an air pressure control unit 78.

The air pressure control unit 78 consists of the elongated tapered barrel 18, having a plurality of radially placed air holes 80. A sleeve 82 has a plurality of orifices 84. The sleeve 82 revolves on the elongated tapered barrel 18 over the air holes 80. When the orifices 84 are in alignment with the air holes 80, air will be introduced into the elongated tapered barrel 18.

LIST OF REFERENCE NUMBERS

16 waterpower pressure washer
18 elongated tapered barrel of 16
20 hollow cylindrical body of 16
22 coupling structure of 16
24 nozzle of 16
26 hose connector for 22
28 fitting on 30
30 garden hose
32 trigger on 20
34 handgrip trigger guard on 20

36 person
38 locking mechanism in 34
40 threaded socket on 18
42 long handle attachment for 40
44 pressure adjustment lever in 18
46 optional hook-up socket in 18
48 bottle
50 threaded neck of 48
52 tank
54 flexible tube on 52
56 threaded fitting on 54
58 internal spiral deflector in 18
60 air introducing facility
62 air inlet assembly for 60
64 collar of 62
66 one-way air valve of 62
68 air valve of 62
70 rotative collar of 62
72 aperture in 70
74 hand pump for 60
75 hand grip pump for 60
76 battery operated pump for 60
78 air pressure control unit for 60
80 air hole in 18
82 sleeve of 78
84 orifice in 82

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A waterpower pressure washer comprising:

a) an elongated tapered barrel;

b) a hollow cylindrical body integral with and fluidly connected at a slight angle to said elongated tapered barrel;

c) means for coupling said hollow cylindrical body to a source of pressurized water, so that the pressurized water can travel through said hollow cylindrical body and said elongated tapered barrel;

d) a nozzle at a distal end of said elongated tapered barrel, so that the pressurized water can be sprayed from said nozzle to clean a surface of an object; and e) means on said elongated tapered barrel for introducing air therein to help accelerate the flow of water therethrough, said air introducing means selected from the group consisting of:

i) an air inlet assembly including a collar mounted on said elongated tapered barrel and a plurality, of one-way air valves radially placed into said elongated tapered barrel on said collar to introduce the air therein;

ii) an air inlet assembly including a plurality of air valves radially placed into said elongated tapered barrel and a collar having a plurality of apertures, said collar rotatively positioned on said elongated tapered barrel over said air valves, so that when said apertures are in alignment with said air valves, air will be introduced into said elongated tapered barrel:

iii) a hand pump built into said elongated tapered barrel;

iv) a handgrip pump built into said elongated tapered barrel;

v) a battery operated pump built into said elongated tapered barrel; and vi) an air pressure control unit including a plurality of radially placed air holes in said elongated tapered barrel and a sleeve having a plurality, of orifices, said sleeve revolvable on said elongated tapered barrel over said air holes, so that when said orifices are in alignment with said air holes, air will be introduced into said elongated tapered barrel.

2. A waterpower pressure washer as recited in claim 1, wherein said coupling means is a hose connector on a free end of said hollow cylindrical body to engage with a fitting on a garden hose.

3. A waterpower pressure washer as recited in claim 1, wherein said nozzle is adjustable on the distal end of said elongated tapered barrel, so that the spray from said nozzle can be changed from a narrow spray to a wide spray.

4. A waterpower pressure washer as recited in claim 1, further including a trigger located on said hollow cylindrical body, so as to turn the pressurized water on and off, as well as to intermediate positions.

5. A waterpower pressure washer as recited in claim 4, further including a handgrip trigger guard on said hollow cylindrical body adjacent said trigger, so as to enable a person to hand hold said handgrip trigger guard and operate said trigger.

6. A waterpower pressure washer as recited in claim 5, further including a locking mechanism in said handgrip trigger guard, so that said locking mechanism can hold said trigger in an operative position to allow the pressurized water to continuously flow therethrough.

7. A waterpower pressure washer as recited in claim 1, further including a threaded socket on said elongated tapered barrel adjacent said hollow cylindrical body, so that a long handle attachment can be connected to said threaded socket, allowing a person gripping said long handle attachment to reach hard to reach places for cleaning.

8. A waterpower pressure washer as recited in claim 1, further including a pressure adjustment lever in said elongated tapered barrel to control the flow of the pressurized water therethrough.

9. A waterpower pressure washer as recited in claim 1, further including an optional hook-up socket fluidly connected on said elongated tapered barrel, so that additives in a bottle with threaded neck and a tank with flexible tube having a threaded fitting, can be attached to said optional hook-up socket and be introduced therethrough.

10. A waterpower pressure washer as recited in claim 1, further including a pair of internal spiral deflectors within said elongated tapered barrel, to agitate the water and help increase the pressure of the water, while also enhancing the scrubbing action of the water as it exits said nozzle.

11. A waterproof pressure washer as recited in claim 1, wherein said air introducing means is an air inlet assembly including:

a) a collar mounted on said elongated tapered barrel; and b) a plurality of one-way air valves radially placed into said elongated tapered barrel on said collar to introduce the air therein.

12. A waterproof pressure washer as recited in claim 1, wherein said air introducing means is an air inlet assembly including:

a) a plurality of air valves radially placed into said elongated tapered barrel; and b) a collar having a plurality of apertures, said collar rotatively positioned on said elongated tapered barrel over said air valves, so that when said apertures are in alignment with said air valves, air will be introduced into said elongated tapered barrel.

13. A waterpower pressure washer as recited in claim 1, wherein said air introducing means is a hand pump built into said elongated tapered barrel.

14. A waterpower pressure washer as recited in claim 1, wherein said air introducing means is a handgrip pump built into said elongated tapered barrel.

15. A waterpower pressure washer as recited in claim 1, wherein said air introducing means is a battery operated pump built into said elongated tapered barrel.

16. A waterproof pressure washer as recited in claim 1, wherein said air introducing means is an air pressure control unit including:

a) a plurality of radially placed air holes in said elongated tapered barrel; and b) a sleeve having a plurality of orifices, said sleeve revolvable on said elongated tapered barrel over said air holes, so that when said orifices are in alignment with said air holes, air will be introduced into said elongated tapered barrel.

17. A waterpower pressure washer as recited in claim 2, wherein said nozzle is adjustable on the distal end of said elongated tapered barrel, so that the spray from said nozzle can be changed from a narrow spray to a wide spray.

18. A waterpower pressure washer as recited in claim 17, further including a trigger located on said hollow cylindrical body, so as to turn the pressurized water on and off, as well as to intermediate positions.

19. A waterpower pressure washer as recited in claim 18, further including a handgrip trigger guard on said hollow cylindrical body adjacent said trigger, so as to enable a person to hand hold said handgrip trigger guard and operate said trigger.

20. A waterpower pressure washer as recited in claim 19, further including a locking mechanism in said handgrip trigger guard, so that said locking mechanism can hold said trigger in an operative position to allow the pressurized water to continuously flow therethrough.

21. A waterpower pressure washer as recited in claim 20, further including a threaded socket on said elongated tapered barrel adjacent said hollow cylindrical body, so that a long handle attachment can be connected to said threaded socket, allowing a person gripping said long handle attachment to reach hard to reach places for cleaning.

22. A waterpower pressure washer as recited in claim 21, further including a pressure adjustment lever in said elongated tapered barrel to control the flow of the pressurized water therethrough.

23. A waterpower pressure washer as recited in claim 22, further including an optional hook-up socket fluidly connected on said elongated tapered barrel, so that additives in a bottle with threaded neck and a tank with flexible tube having a threaded fitting, can be attached to said optional hook-up socket and be introduced therethrough.

24. A waterpower pressure washer as recited in claim 23, further including a pair of internal spiral deflectors within said elongated tapered barrel, to agitate the water and help increase the pressure of the water, while also enhancing the scrubbing action of the water as it exits said nozzle.

25. A waterproof pressure washer as recited in claim 24, wherein said air introducing means is an air inlet assembly including:

a) a collar mounted on said elongated tapered barrel; and b) a plurality of one-way air valves radially placed into said elongated tapered barrel on said collar to introduce the air therein.

26. A waterproof pressure washer as recited in claim 24, wherein said air introducing means is an air inlet assembly including:

a) a plurality of air valves radially placed into said elongated tapered barrel; and b) a collar having a plurality of apertures, said collar rotatively positioned on said elongated tapered barrel over said air valves, so that when said apertures are in alignment with said air valves, air will be introduced into said elongated tapered barrel.

27. A waterpower pressure washer as recited in claim 24, wherein said air introducing means is a hand pump built into said elongated tapered barrel.

28. A waterpower pressure washer as recited in claim 24, wherein said air introducing means is a handgrip pump built into said elongated tapered barrel.

29. A waterpower pressure washer as recited in claim 24, wherein said air introducing means is a battery operated pump built into said elongated tapered barrel.

30. A waterproof pressure washer as recited in claim 26, wherein said air introducing means is an air pressure control unit including:

a) a plurality of radially placed air holes in said elongated tapered barrel; and b) a sleeve having a plurality of orifices, said sleeve revolvable on said elongated tapered barrel over said air holes, so that when said orifices are in alignment with said air holes, air will be introduced into said elongated tapered barrel.

* * * * *